United States Patent [19]

Kimoto

[11] Patent Number: 4,852,285

[45] Date of Patent: Aug. 1, 1989

[54] LUMINOUS GAS-DISCHARGE SIGN PANEL

[75] Inventor: Masaaki Kimoto, Ikoma, Japan

[73] Assignee: Kimoto Sign Co. Ltd., Osaka, Japan

[21] Appl. No.: 687,632

[22] Filed: Dec. 31, 1984

[30] Foreign Application Priority Data

Dec. 30, 1983 [JP] Japan ..... 58-248828

[51] Int. Cl.[4] ..... G09F 13/20

[52] U.S. Cl. ..... 40/542; 313/513

[58] Field of Search ..... 313/513, 514, 515; 40/545, 542

[56] References Cited

U.S. PATENT DOCUMENTS

| | | | |
|---|---|---|---|
| 714,233 | 11/1902 | Flancon | 40/545 |
| 1,743,569 | 1/1930 | Purdom | 40/545 |
| 1,865,253 | 6/1932 | Hotchner | 40/545 |
| 2,095,291 | 10/1937 | Schneider | 40/545 |
| 2,852,877 | 9/1958 | Goebel | 40/545 |
| 3,507,065 | 4/1970 | Fullerton | 40/545 |

*Primary Examiner*—Gene Mancene
*Assistant Examiner*—Wenceslao J. Contreras
*Attorney, Agent, or Firm*—Lyon & Lyon

[57] ABSTRACT

A luminous gas-discharge sign panel devised so that the brightness of sign is made constant throughout the entire length of the gas-discharge path irrespective of the positional width variations of the luminous sign patterns.

6 Claims, 3 Drawing Sheets

FIG. 2.
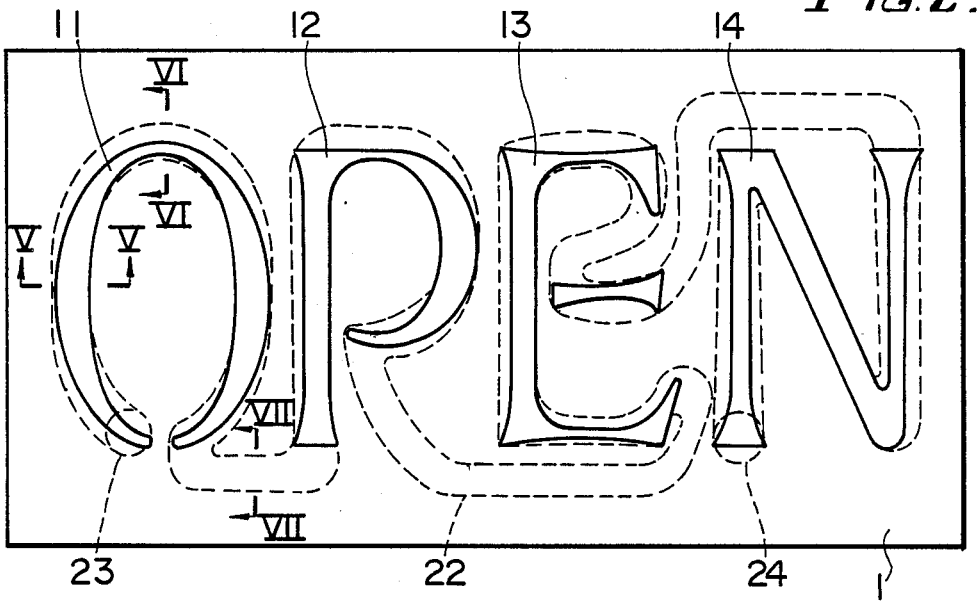
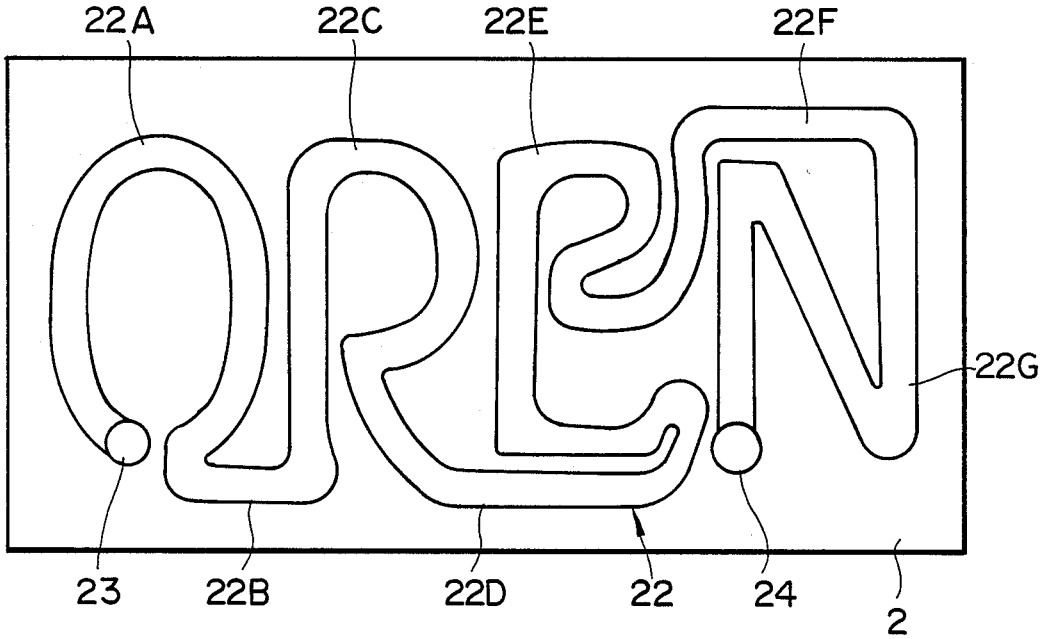
FIG. 3.

LUMINOUS GAS-DISCHARGE SIGN PANEL

BACKGROUND OF THE INVENTION

1. Field of the Invention

The present invention relates to a luminous gas-discharge sign panel and more particularly to a panel type "neon sign" devised so that its individual sign pattern constituting elements may bright evenly irrespective of their widths.

2. Prior Art

A commonly called "neon sign" is usually made up of a sign or a plurality of bend-worked gas-discharge tubes of glass. As a matter of course, a gas-discharge tube must be constituted by a continuous discharge path, therefore, if a sign pattern, as is often the case, consists of a plurality of pattern-constituting elements, the pattern must be constituted either with a plurality of gas-discharge tubes or with a partially light-shielded single gas-discharge tube. The use of many discharge tubes results in the complexity of tube arrangements and electric wirings, whereas partial light shielding, practiced usually with bad-looking opaque bandage or coatings applied to the tube, injures the beauty of the neon sign, particularly in the daytime when the neon sign is kept non-luminous. Besides, the gas-discharge tubes themselves are not only fragile but also unsuitable for the mass-production of the same-patterned neon sign.

To overcome the above disadvantages, panel type neon signs have been proposed, for example, in U.K. Pat. No. 400,646 and Canadian Pat. No. 592,921. However, the panel type neon signs disclosed in these patent documents still have many important disadvantages, and probably under such circumstances they have not yet been put into practice. In the U.K. patent, for example, an interposed sheet made of a material such as cellulose is used between a front and a rear plates to stick them together, both the plates being provided with grooves forming a discharge path. In such a construction the outgases from the interposed cellulose sheet come to prevent a normal discharge and make the product impractical. On the other hand the Canadian patent has a problem in welding the front and the rear plates, namely in the method of glass work.

The inventor of the present patent application also proposed an improved panel type neon sign in Japanese Utility Model Publication No. 57-60050, and has already succeeded industrially and commercially in putting it into practice. However, this also has a disadvantage that the width of the individual luminous elements constituting a sign pattern must be constant throughout the whole length of the pattern for an even or uniform brightness of the sign. In addition this panel type neon sign also has a disadvantage that its appearance in the daytime is not completely free from being injured aesthetically by an interference between the ambient light reflections from the front and back plates constituting the sign panel.

OBJECTS AND SUMMARY OF THE INVENTION

An object of the present invention is to provide a luminous gas-discharge sign panel capable of being made uniformly luminous at any position on the sign pattern even if the pattern is constituted with various luminous elements whose widths vary positionally.

Another object of the present invention is to provide a luminous gas-discharge sign panel made free from a bad-looking appearance due to the interference between the daytime light reflections from the front and back plate constituting the sign panel.

For the achievement of these objects, a luminous gas-discharge sign panel according to the present invention comprises a pair of electrodes and a panel made up of two plates facedly bonded together on their respective inner sides: one is a front plate being transparent and provided with main grooves which sink in on the inner side and extrude from the outer side; and the other is a back plate being provide with a continuous subordinate groove sinking in on the inner side. The main grooves of the front plate are the pattern elements to constitute an entire sign pattern, while the continuous groove of the back plate forms a continuous gas-discharge path in company with the above main grooves of the front plate. Further, each of said pair of electrodes is provided at each end of the continuous subordinate groove. There is, of course, confined a discharge gas such as neon, argon or helium.

BRIEF DESCRIPTION OF THE DRAWINGS

The details of the present invention will be described in the following in reference to the attached drawings, in which:

FIG. 2 shows the front view of the above embodiment;

FIG. 3 shows the front view of the back plate of the above embodiment with the front plate removed;

DETAILED DESCRIPTION OF THE INVENTION

Figure 1:
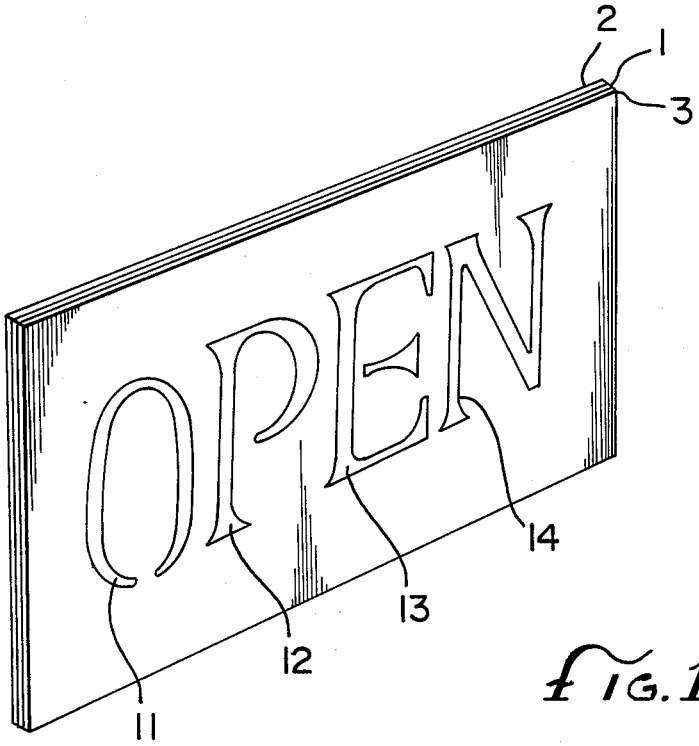
FIG. 1 shows a perspective view of an embodiment of the present invention.
Figure 4:
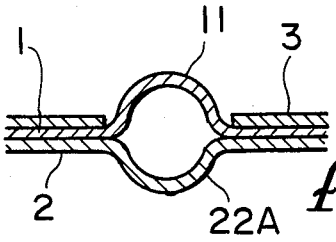
FIGS. 4, 5 and 6 show the cross-sectional views taken along the lines V—V, VI—VI and VII—VII in FIG. 2, respectively.
Figure 5:
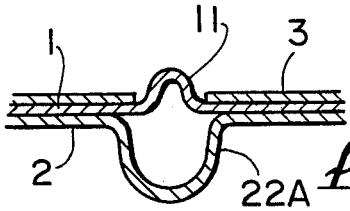
Figure 6:
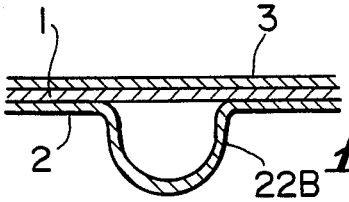
Figure 7:
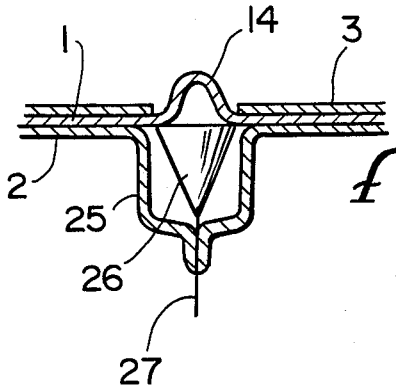
FIG. 7 shows an electrode provided at one end of the discharge path of the above embodiment.

As is shown in FIG. 1 which shows a perspective view of an embodiment of the present invention, a typical luminous gas-discharge sign panel of the invention comprises a front plate 1, a back plate 2 and a masking 3 applied to the front plate 1 excluding sign-patterned portions. The front plate 1 and the back plate 2 are bonded together on their respective inner sides. The front plate 1 has main grooves sinking in on its inner side and projecting on its outer side. The main grooves in this embodiment constitute sign patterns 0, P, E and N, as is seen both in FIG. 1 and in FIG. 2, which shows the front view of the front plate 1. FIG. 3 shows the front view of the back plate 2 viewed with the front plate 1 removed. As is shown in FIG. 3 the back plate 2 has a continuous subordinate groove 22, which constitutes a continuous gas-discharge path in company with the main grooves (and non-grooved flat portions) of the front plate 1. A dotted line in FIG. 2 corresponds to the continuous subordinate groove of the back plate 2. FIGS. 4, 5 and 6 show three representative cross sections of the thus constituted discharge path. These cross sections are taken along lines V—V, VI—VI and VII—VII in FIG. 2, and it should be noted that the continuous subordinate groove of the back plate 2 is sized so that the cross-sectional area of the gas-discharge path may be kept constant throughout the entire length of the discharge path irrespective of the widths and depths of the main grooves (constituting the sign patterns OPEN) provided to the front plate 1. By this constitution of the discharge path, all the portions on all the sign patterns are assured of brighting uniformly irrespective of widths of the sign pattern-constituting individual luminous elements. In these figures FIGS. 4, 5 and 6, reference number 3 indicates the masking applied to the front plate with the sign pattern portions excluded. FIG. 7 shows one of a pair of electrodes to be provided at both ends of the gas-discharge path. For providing the electrodes each end of the subordinate continuous groove has a projection 25 in which one of the electrodes 26 is enclosed with a lead wire 27 drawn outwardly through the end wall of the projection 25.

Figure 8:
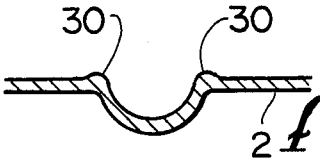
FIG. 8 shows a protuberance formed at the sinking fringe of a groove.
Figure 9:
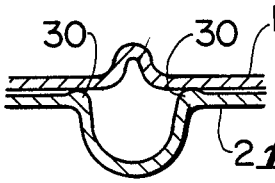
FIGS. 9 and 10 show another method of bonding of a front and a back plate in the present invention.
Figure 10:
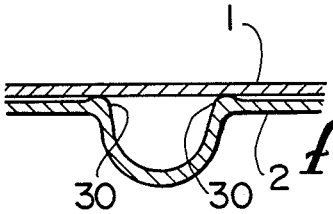

In the above embodiment the bonding of the front plate 1 and the back plate is executed by welding with their respective flat portions fitted together, as is shown in FIGS. 4 to 7. However the bonding can be executed at protuberant portions (denoted by a reference number 30 in FIGS. 8, 9 and 10) formed along the sinking edges of the continuous subordinate groove provided to the back plate 2. This method of bonding makes a relatively thick clearance between the flat portions of the front and the back plates 1 and 2. The thus made clearance, which is usually thicker than the wave lengths of the visible lights, makes the sign panel free from a bad-looking appearance due to the interference between the ambient light reflections by the bottom boundary surface of the front plate 1 and the upper boundary of the back plate 2. Such a bad-looking appearance is liable to accompany a sign panel constituted with the flat portions of the front and the back plates bonded together, because a complete bonding without any thin clearances left between the flat portions is not always possible and such a thin clearance may cause a light interference.

What is claimed is:

1. A luminous gas-discharge sign panel comprising:

a panel made up of a transparent front plate and a back plate, both being facedly bonded together on their respective inner sides; and a pair of electrodes, said transparent front plate having main grooves sinking on its inner side and extruding on its outer side;

said main grooves being noncontinuous forming a pattern to be made luminous by gas discharging;

said back plate having a continuous subordinate groove sinking on the inner side of said back plate, forming a continuous gas discharge path in company with said transparent front plate including the parts where said main grooves are formed;

said gas discharge path having a constant cross-sectional area throughout the whole length of the same and being filled with a discharge gas at a predetermined pressure; and each of said pair of electrodes being provided at each end of said gas discharge path.

2. A luminous gas-discharge sign panel defined in claim 1, wherein the bonding of said transparent front plate and said back plate on their respective inner sides is executed at the slightly protuberant portion formed along the sinking fringe of said continuous subordinate groove.

3. A luminous gas-discharge sign panel defined in claim 1 or 2, wherein said transparent front plate is masked with an opaque film except the area where said main grooves extrude forming said patterns to be made luminous by gas discharging.

4. A luminous gas-discharge sign panel comprising:

a panel made up of a transparent front plate and a back plate, both being facedly bonded together on their respective inner sides;

main grooves forming a pattern to be illuminated sinking in the inner side of said front transparent plate;

a continuous second groove sinking in the inner side of said second plate, said back groove forming a continuous gas discharge path in company with the grooved and non-grooved flat portions of said transparent front plate, said gas discharge path being filled with a discharge gas at a predetermined pressure; and a pair of electrodes, one electrode being provided at each end of said gas discharge path.

5. A luminous gas-discharge sign panel comprising:

a panel made up of a transparent front plate and a back plate, both being facedly bonded together on their respective inner sides;

a main groove pattern sinking on the inner side of said front plate forming a pattern to be illuminated, said main groove pattern comprising at least one groove of varying width;

a continuous groove sinking on the inner side of said back plate, forming a continuous gas discharge path in company with said transparent front plate;

electrodes positioned at each end of said gas discharge path.

6. A luminous gas-discharge sign panel comprising:

a panel made up of a transparent front plate and a back plate, both being facedly bonded together on their respective inner sides;

a main groove pattern sinking on the inner side of said front plate forming a pattern to be illuminated, said main groove pattern comprising at least one groove of varying depth;

a continuous groove sinking on the inner side of said back plate, forming a continuous gas discharge path in company with said transparent front plate;

electrodes positioned at each end of said gas discharge path.

* * * * *